US005913755A

United States Patent [19]

Chung

[11] Patent Number: 5,913,755

[45] Date of Patent: Jun. 22, 1999

[54] STRETCHING DEVICE FOR INCREASING UPPER TORSO FLEXIBILITY

[76] Inventor: John H. Chung, 11655 Gorham Ave. #9, Los Angeles, Calif. 90049

[21] Appl. No.: 09/019,814

[22] Filed: Feb. 6, 1998

[51] Int. Cl.[6] ..... A63B 21/02; A63B 23/02

[52] U.S. Cl. ..... 482/123; 482/130; 482/134; 482/907

[58] Field of Search ..... 482/20, 44, 121–123, 482/127–130, 133–136, 139, 142, 905, 907, 908; 601/23, 24, 33; 297/340, 353

[56] References Cited

U.S. PATENT DOCUMENTS

| | | | |
|---|---|---|---|
| 3,563,542 | 2/1971 | Wellman et al. | 482/123 |
| 4,575,076 | 3/1986 | Reichert et al. . | |
| 4,693,468 | 9/1987 | Kurlytis et al. . | |
| 4,822,027 | 4/1989 | Kascak . | |
| 4,944,518 | 7/1990 | Flynn . | |
| 5,087,038 | 2/1992 | Hao et al. . | |
| 5,099,831 | 3/1992 | Freed . | |
| 5,110,121 | 5/1992 | Foster . | |
| 5,529,560 | 6/1996 | Davies, III et al. . | |
| 5,558,624 | 9/1996 | Hepburn et al. . | |
| 5,626,547 | 5/1997 | Davies, III et al. . | |
| 5,637,062 | 6/1997 | Schmittner . | |
| 5,695,250 | 12/1997 | Lin | 297/353 |
| 5,758,926 | 6/1998 | Wilkie et al. | 297/423.19 |
| 5,803,876 | 9/1988 | Hickman | 482/123 |
| 5,803,878 | 9/1998 | Chiang | 482/136 |

FOREIGN PATENT DOCUMENTS

| | | | |
|---|---|---|---|
| 186928 | 7/1986 | European Pat. Off. | 482/133 |
| 84/04690 | 12/1984 | WIPO | 482/130 |
| 91/12854 | 9/1991 | WIPO | 482/122 |
| 94/06518 | 3/1994 | WIPO | 482/121 |

*Primary Examiner*—Jeanne M. Clark
*Attorney, Agent, or Firm*—Antonelli, Terry, Stout & Kraus, LLP

[57] ABSTRACT

A portable stretching device includes a seat portion on which the athlete sits so that an upright axle frame of the stretching device extends in an upwardly vertical direction from the area between the athlete's thighs. The athlete then grips a handle which is located at the end of a "swing" arm of the stretching device, which extends outwardly from the upright axle frame, away from the athlete, at approximately chest-level. The stretching device also includes thigh supports on the seat portion, which enable an athlete user to stabilize the device while performing stretching exercises. The athlete user then grips the handle, and then allows a retracting force applied to the swing arm to twist his/her torso to either side while the seat portion of the device remains stationary, thus simulating a full shoulder turn required for an optimal swing for golf, hockey, tennis (and other racquet sports) and baseball and softball. The twisting of the user's torso and the corresponding rotation of the handle via the swing arm turns an axle which is located in the upright axle frame which extends downward into the interior of the seat portion. Thus, the swing arm turns in correspondence with an adjustable tension assembly which retracts the swing arm to a point of least resistance which simulates the full shoulder turn for the user. Through deliberate and repeated use of the invention, the athlete is able to significantly increase flexibility, as well as strengthen, the muscles utilized in producing a more open shoulder turn which is beneficial in sports such as golf, hockey, baseball and softball.

5 Claims, 9 Drawing Sheets

STRETCHING DEVICE FOR INCREASING UPPER TORSO FLEXIBILITY

BACKGROUND OF THE INVENTION

The present invention relates to an apparatus for increasing the range of flexibility in a person's upper torso by stretching a user's shoulder turn.

A primary factor in increasing the distance and/or velocity in a golf shot, hockey slap-shot, swing in racquet sports (e.g. tennis, racquetball, squash, etc) or hit in either baseball or softball is developing an extended shoulder turn. The shoulder turn requires that the athlete's shoulders be rotated as far as possible by twisting the upper torso with the player's spine serving as a central axis thereof. Golfers experience greater distance in their shots, and hockey, baseball and softball players experience greater velocity in their hits when they achieve a more complete shoulder turn since the arc of their swings is increased, thus increasing the swing speed. The faster the golf club, hockey stick, and baseball and softball bats are being swung at the moment of impact with the respective balls and puck, the further and/or faster the balls and puck will travel.

To date, the sports equipment market has received numerous entries for improving an athlete's swing by providing resistance or simulating an "ideal" swing. Furthermore, none of the equipment designed to improve a user's upper torso flexibility produce an increase in the user's shoulder turn for increasing the radius and velocity of his or her swing. Such references include U.S. Pat. Nos. 5,529,560 and 5,626,547 (Davies, III et al) which describe stretch therapy apparatuses which stretches the user's torso oriented at various inclinations with respect to his or her legs; and U.S. Pat. No. 5,558,624 (Hepburn, et al) which describes a shoulder physical therapy apparatus which provides tension to an isolated shoulder.

SUMMARY OF THE INVENTION

The object of the present invention is to improve an athlete's performance by increasing the range of flexibility of the athlete's upper torso. Athletes including golfers, as well as hockey players, tennis players (or other racquet sports), baseball players and softball players, would benefit from the extended stretching capabilities provided by the invention for the upper torso.

The object of the present invention is met by providing a portable stretching device which includes a seat, an adjustable tension assembly housed in the seat, a rotatable bearing assembly extending from the interior of the seat, an axle extending upward from the rotatable bearing assembly, and a hand extension to accomodate the outstretched arms of the user to thereby rotate the upper torso of the user.

In particular, the seat portion on which the athlete sits is provided so that an upright axle frame of the stretching device extends in an upwardly vertical direction from the area between the athlete's thighs. The stretching device also includes thigh supports on the seat portion, thus enabling the athlete to stabilize the stretching device while performing stretching exercises. The upright axle frame extends from the vertex of the thigh supports.

Upon sitting on the seat and straddling the thigh supports, the athlete then grips a handle which is located at the end of a "swing" arm of the stretching device, which extends outwardly from the upright axle frame. The swing arm has a corresponding axle assembly, located inside of the seat portion on which the athlete sits, which is parallel to the swing arm and turns on the same axle as the swing arm, wherein the axle runs vertically through the upright axle frame. A pulling force is applied to the axle assembly, and the point of rest at which the least amount of pulling force is applied thereto is the position corresponding to a full upper torso turn by the athlete, to either the left or the right. The point of greatest tension applied to the axle assembly is the position at which the swing arm is fully extended horizontally outwardly from the athlete user, which is also the starting position for the stretching exercises associated with the present invention.

As the athlete sits on the seat portion, straddling the thigh supports, he/she grips the handle at its point of greatest tension, and then allows the pulling force applied to the axle assembly to slowly pull the swing arm to its point of least pulling tension, thus twisting the athlete's torso to simulate a full shoulder turn as performed during an optimal swing of a club, bat, racquet or stick.

Thus, through deliberate and repeated use of the invention, the athlete is able to significantly increase flexibility, as well as strengthen, the muscles utilized in producing a more open shoulder turn which is beneficial in sports such as golf, hockey, tennis, baseball and softball.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS

Preferred embodiments of the present invention will be described with reference to FIGS. 1–9.

Figure 1:
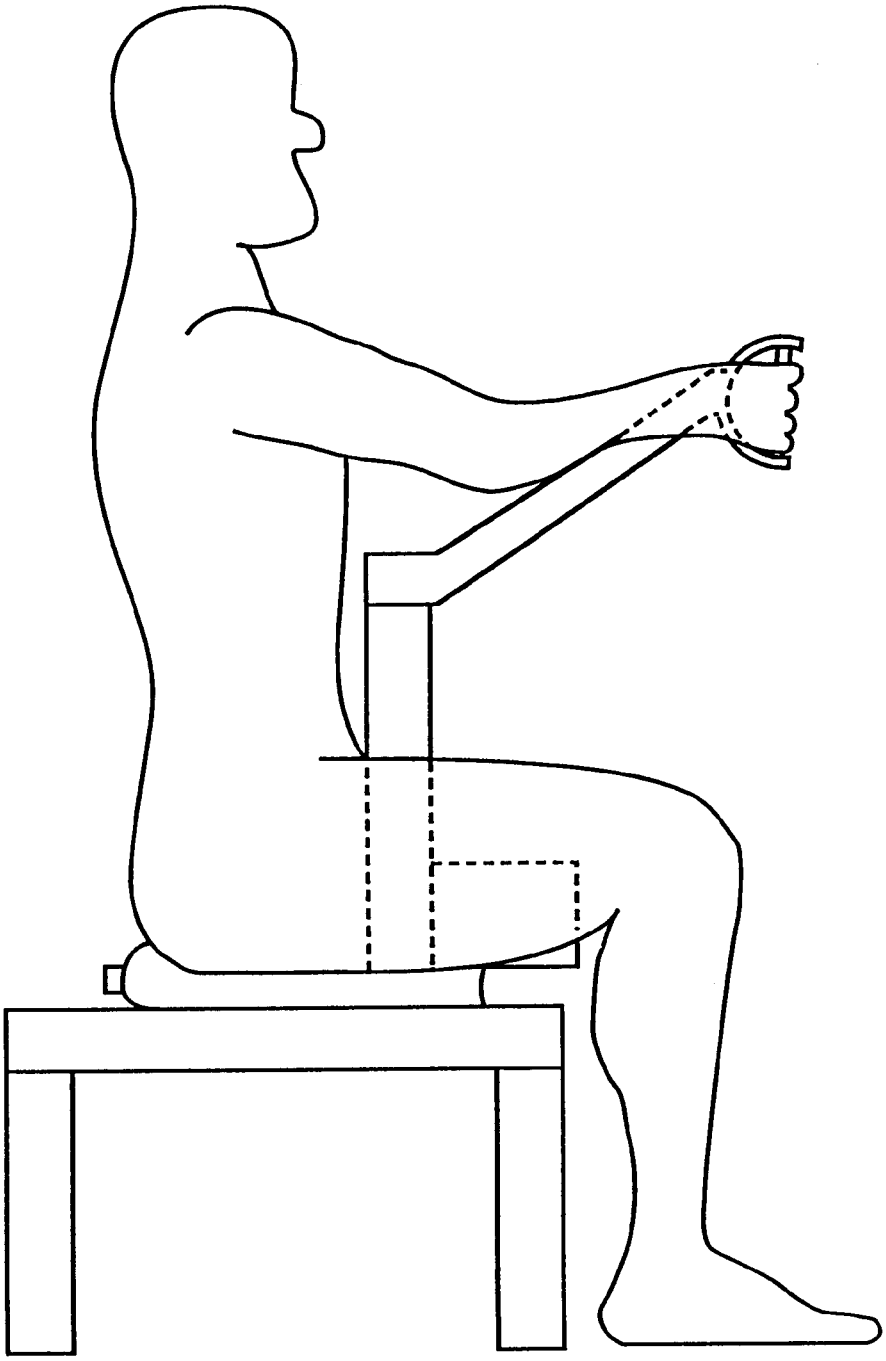
FIG. 1 depicts an athlete-user properly poisitioned to use the present invention, with the swing arm disposed at the point of greatest tension.

FIG. 1 shows an athlete-user of the present invention properly positioned to utilize the stretching device of the present invention.

Figure 2:
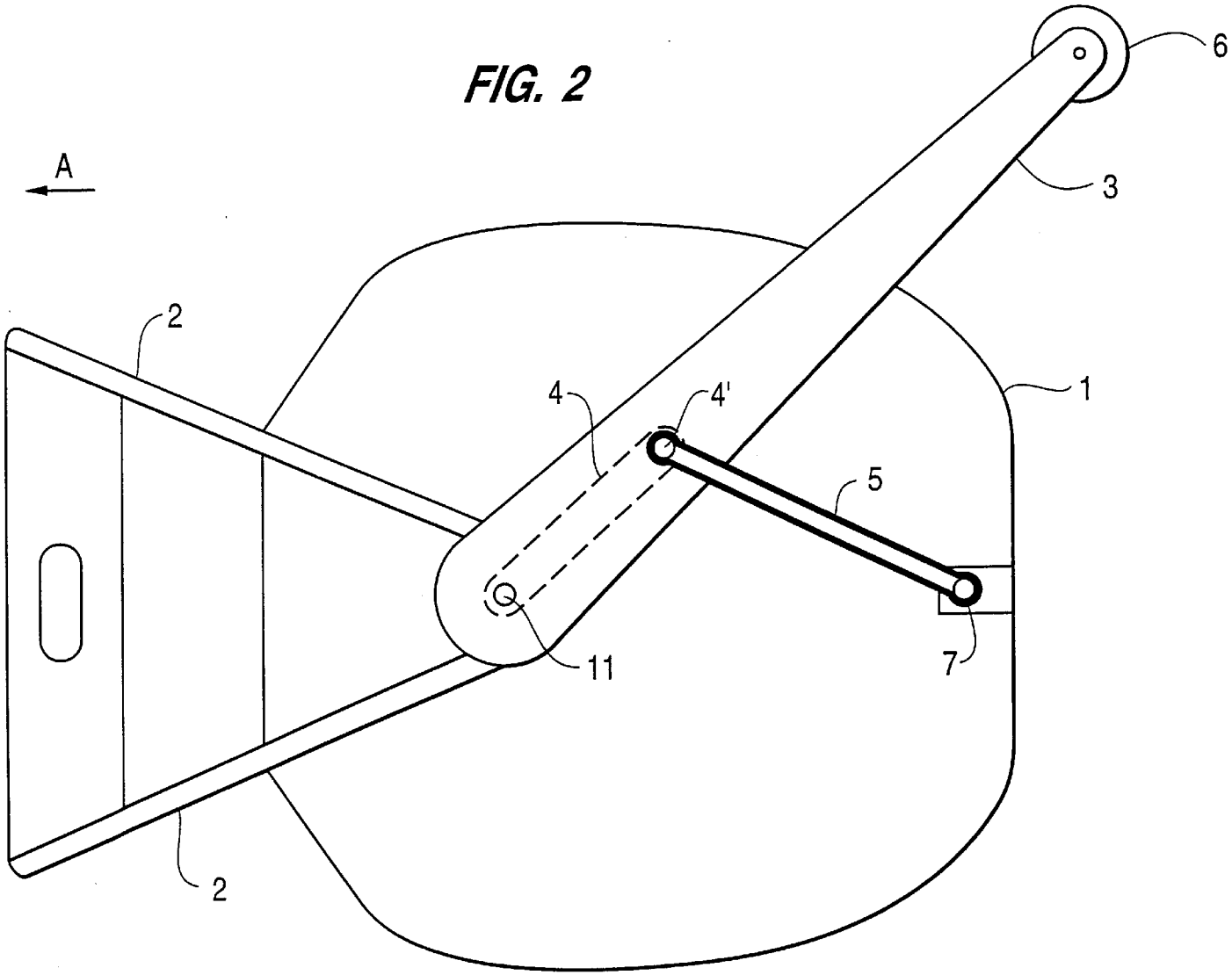
FIG. 2 shows a top view of a preferred embodiment of the stretching device of the present invention, at its point least pulling force, wherein an elastic band is utilized to apply a pulling force to the axle assembly.
Figure 7:
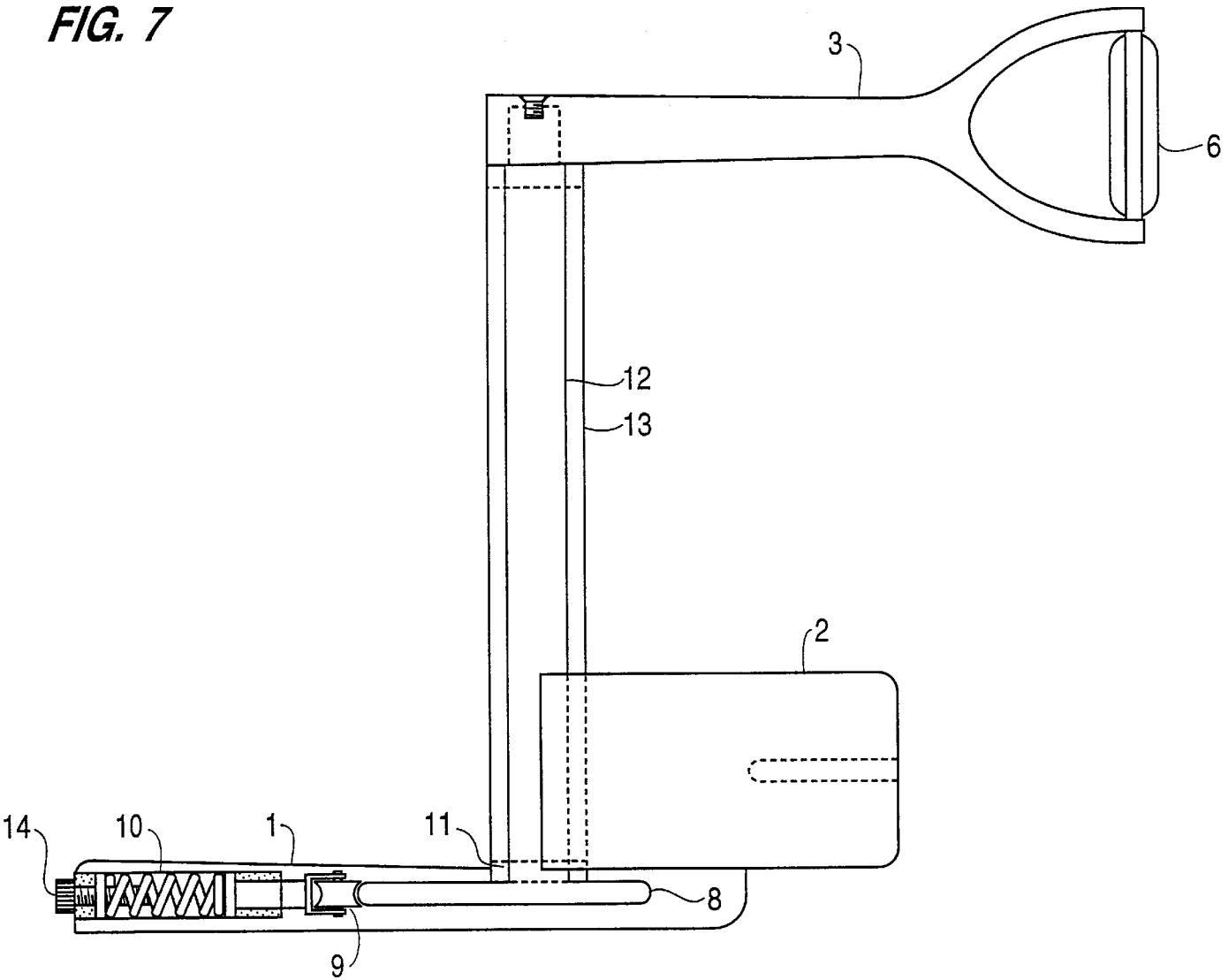
FIG. 7 shows a side view of present invention, wherein the tension assembly is a spring-loaded piston according to the second embodiment thereof.

The stretching device includes seat 1, which has thigh stabilizers 2 extending outwardly therefrom in direction A, which is along the athlete user's line of sight when sitting on the stretching device. In the preferred embodiment of FIG. 2, movement of swing arm 3 is controlled by the pulling force applied to axle assembly 4 by the elastic band 5 which is disposed in the interior of seat 1 and is anchored at a rear portion thereof at base 7. Referring in part to FIGS. 2 and 7, swing arm 3 and axle assembly 4 are disposed on opposite ends of axle 12 which runs vertically through axle shaft 13, with swing arm 3 disposed atop the axle shaft 13 at approximately chest level of the user, and axle assembly 4 being disposed at a lower portion of axle shaft 13. In fact, axle assembly 4, located in the interior portion of seat 1, turns on roller bearings 11, and is parallel to swing arm 3 though not necessarily the same length thereof.

Figure 3:
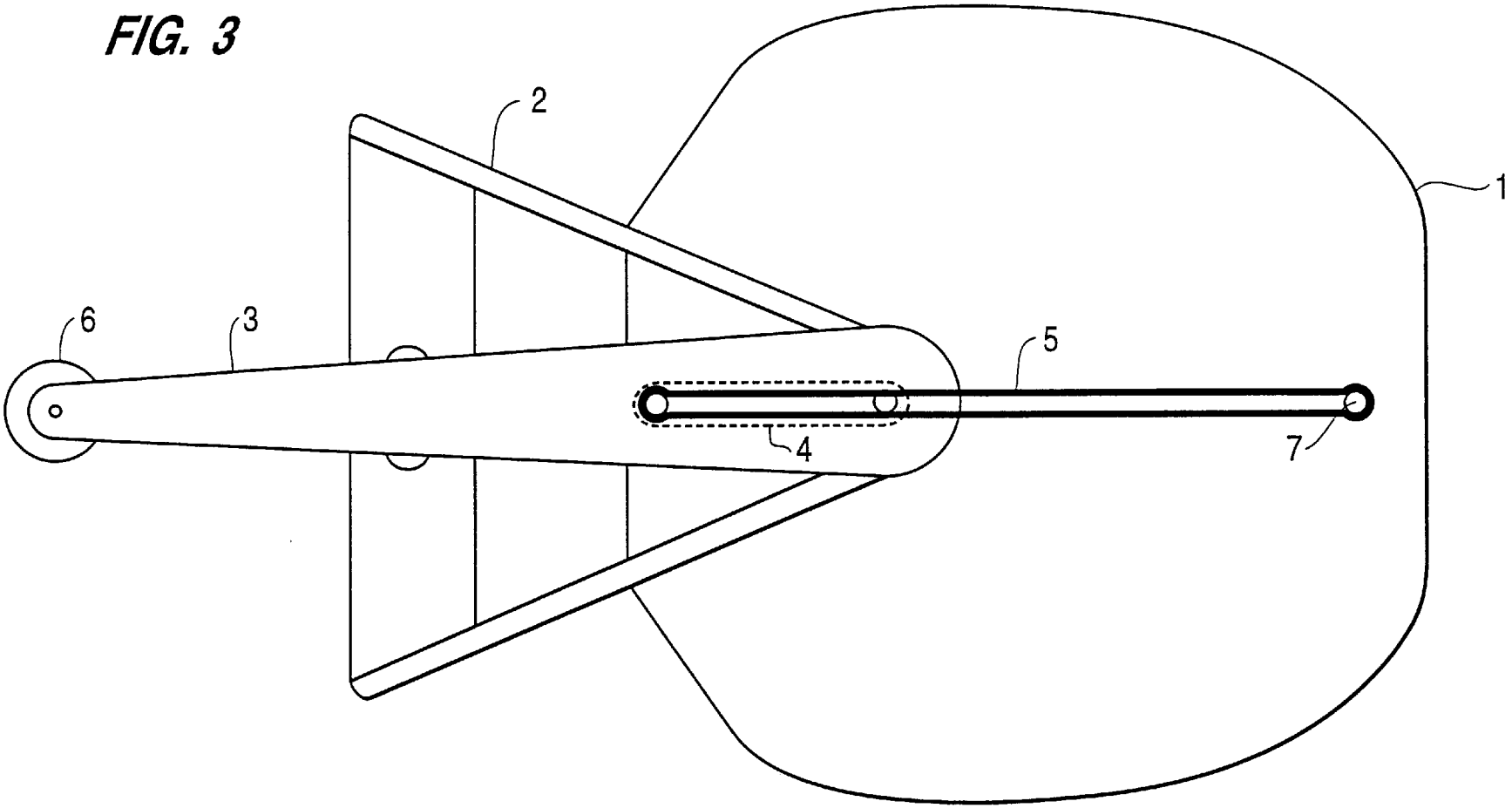
FIG. 3 shows a top view of the preferred embodiment of the present invention at its point of greatest tension.

To use the portable stretching device of the present invention, the stretching device is preferably placed on a chair which enables the user to place his/her feet flatly on the ground. Then, the user sits maneuvers swing arm 3 to its point of greatest tension, as shown in FIG. 3. At the point of greatest tension, the distance between the base 7 and the axle assembly base 4' is at its greatest length, and therefore the elastic band 5 is stretched to its maximum amount of tension in the stretching device, with a natural tendency to pull the axle assembly 4, and consequently the swing arm 3 as well, back to its point of least pulling force shown in FIG. 2.

Then, the user sits on the seat 1 while straddling the thigh stabilizers 2. The thigh stabilizers 2 keep the apparatus, particularly the seat 1, stable relative to the user while performing stretching exercises using the apparatus. Before beginning the stretching exercise, the user should sit up straight and adjust the height of the axle shaft 13 so that the swing arm 3 is substantially chest-high. Next, once the user grabs the handle/grip 6 at the end of swing arm 3, he/she is in the proper posture for beginning stretching exercises as seen in FIG. 1.

For the sake of the present description, it is assumed that the user is right-handed and thus swings a golf club, hockey stick, racquet and baseball or softball bat from the right side, although the present invention is compatible for left-handed athletes, as well. Therefore, having assumed the starting position shown in FIG. 1, the user begins a turning motion to the right, simulating the twisting motion utilized in the swings described above. Of course, the pulling force applied by the retraction of elastic band 5 to the axle assembly 4, and consequently swing arm 3 as well, will return the swing arm 3 to its point of rest shown in FIG. 2. Thus, as the user holds the handle/grip 6, he/she applies some resistance to the pulling force which is created by the elastic band 5 to slowly twist the user's upper torso to simulate a full and complete swing of a golf club, hockey stick, racquet or baseball or softball bat. It should be noted that tension exerted by the elastic band 5 is varied by utilizing elastic bands of various diameter and/or thickness, as well as by using multiple bands. When the swing arm 3 reaches its point of rest, the user then turns the swing arm 3 back to its point of greatest tension and begins the exercise again. Slow and deliberate repetitions of such stretching exercises will develop a more complete shoulder turn for the athlete, thus enhancing his/her performance.

Figure 6A:
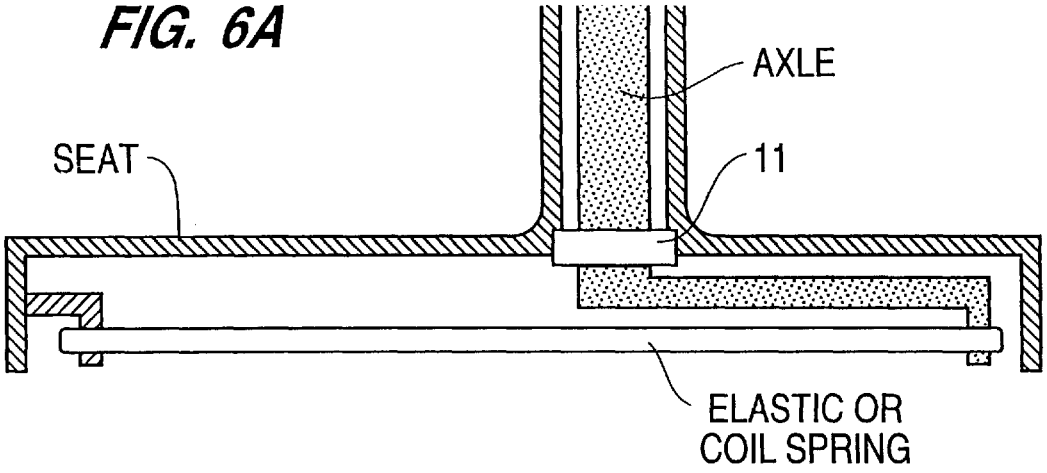
FIGS. 6A and 6B show a side and top view, respectively, of the tension assembly of the preferred embodiment of the present invention.
Figure 6B:
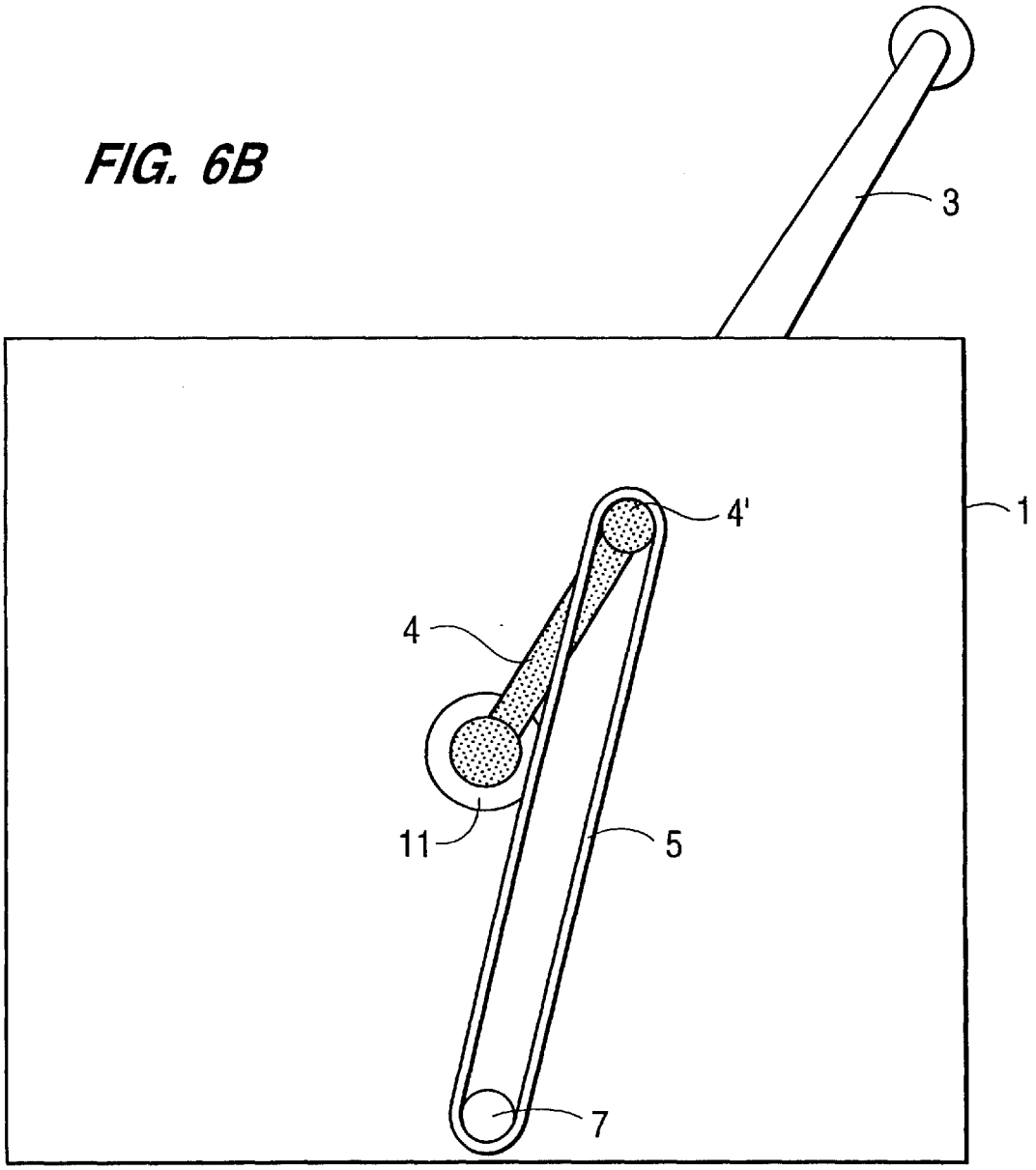

FIGS. 6A and 6B show a cross-sectional view and a top view, respectively, of the interior of the seat 1, wherein the elastic band 5 or a coil spring is anchored to the seat at base 7 and to the axle assembly 4 at base 4' to provide a pulling force to the axle assembly, and consequently swing arm 3 as well, to stretch the upper torso of the athlete to simulate a full shoulder turn. The axle assembly 4 and swing arm 3 move in correspondence with each other by the turning of axle 12 upon the bearings 11.

Figure 4:
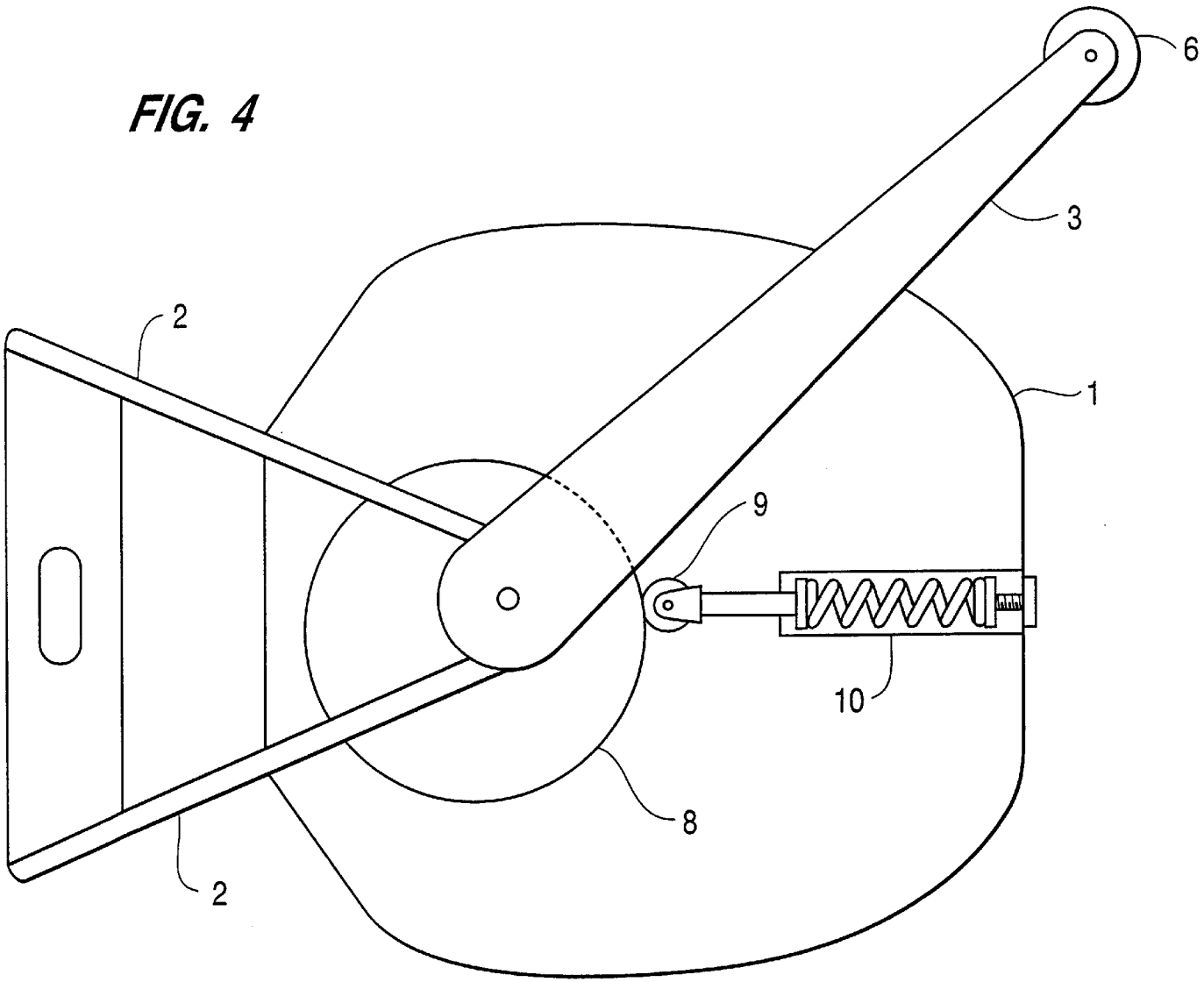
FIG. 4 shows a top view of a second embodiment of the present invention, at its point of least tension, wherein a spring-loaded piston is utilized to apply the pulling force to the axle assembly.
Figure 5:
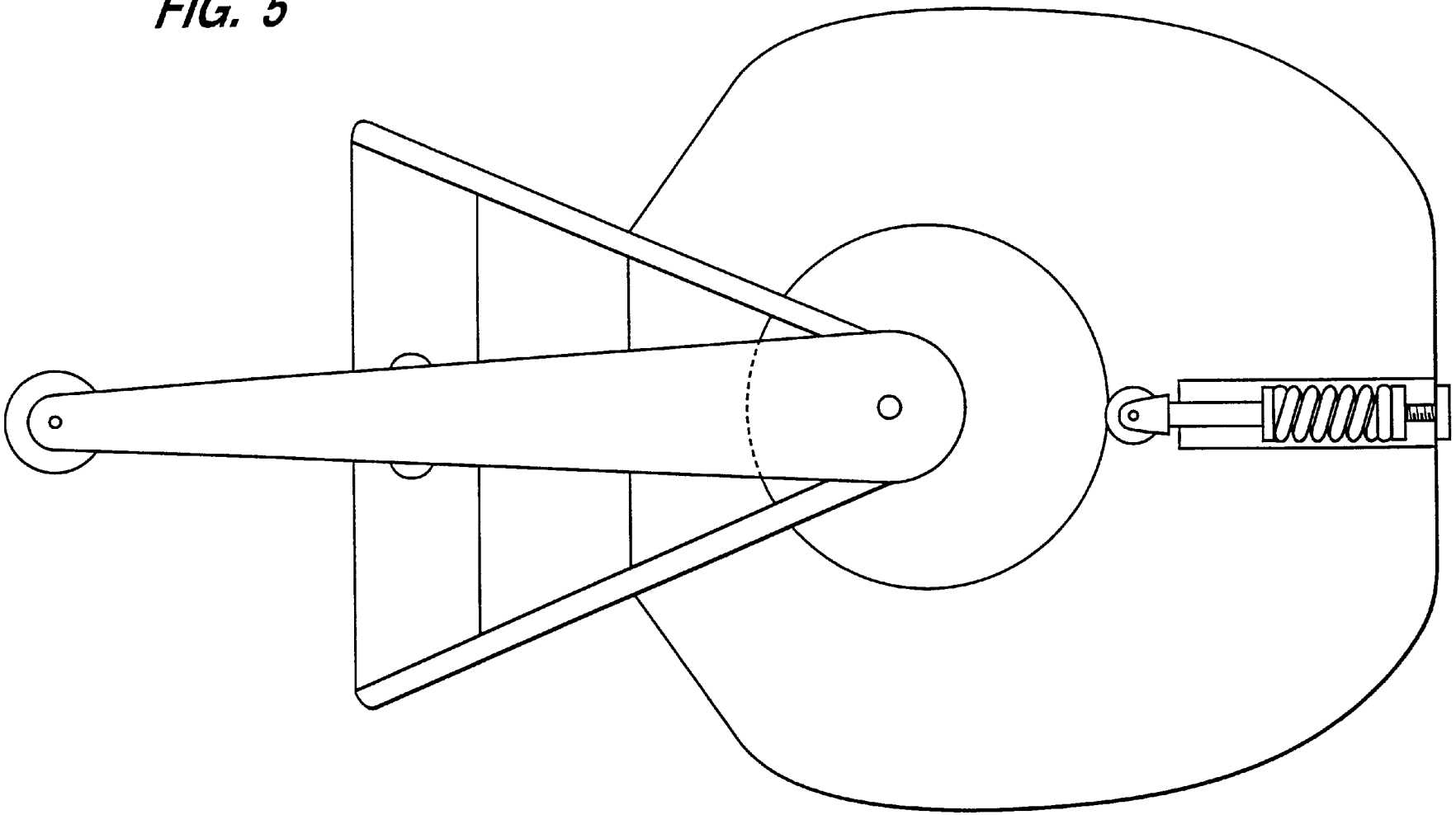
FIG. 5 shows a top view of the second embodiment of the present invention at its point of greatest tension.

FIGS. 4 and 5 show a second embodiment of the present invention, at its point of rest and greatest tension respectively, wherein a spring loaded piston 10 and rotatable variable resistance guide 8 are utilized to turn the swing arm 3, thus simulating a full shoulder turn for the user.

Figure 8:
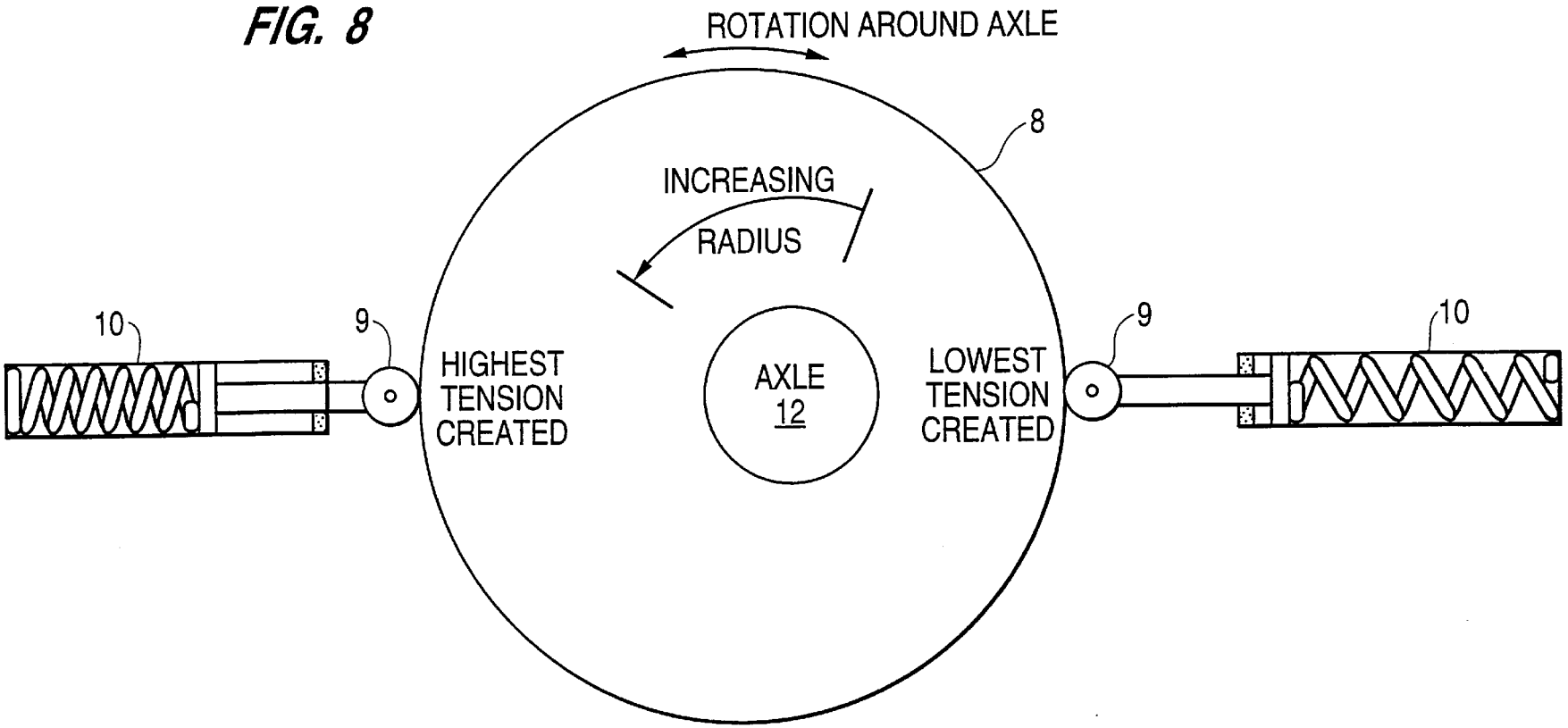
FIG. 8 depicts the points of greatest and least tension applied to the axle assembly of the second embodiment of the present invention.

As seen in FIG. 8, the rotatable variable resistance guide 8 is elliptical. FIG. 8 shows the rotatable variable resistance guide 8 relative to spring-loaded piston 10 to create the highest amount of tension, as depicted in FIG. 5, and the least amount of tension, as depicted in FIG. 4. In practice, the user maneuvers the swing arm 3 into its beginning position and therefore the variable resistance guide 8 and spring-loaded piston 10 are at the position of highest tension 4A, seen in FIG. 8. Then, user sits on the seat 1, grabs the handle/grip 6, and applies resistance to the pulling force exerted by the swing arm 3, as the spring-loaded piston decompresses, thus utilizing roller guide 9 to influence the variable resistance guide 8 to return to its point of least tension. Accordingly, the swing arm 3, which turns as the variable resistance guide turns via roller bearings 11, is forcibly returned to its point of rest, thus providing the user with a full turn of the shoulders.

Figure 9:
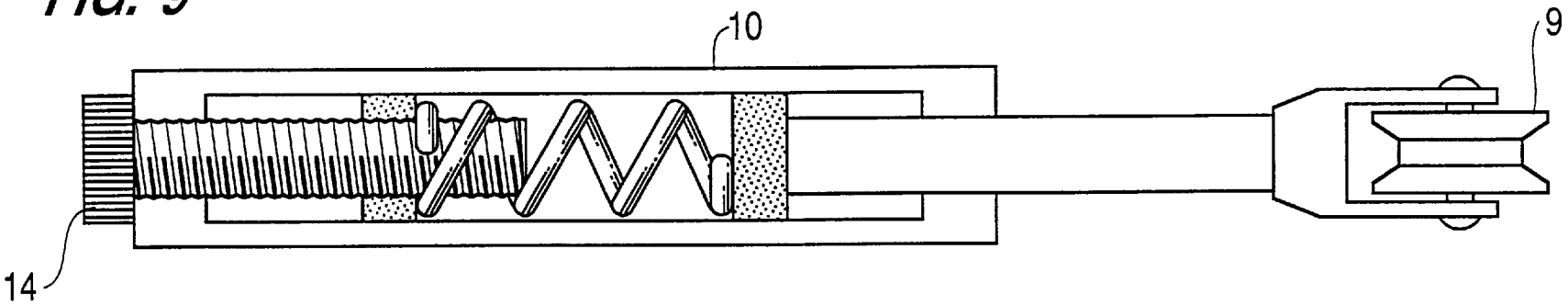
FIG. 9 shows the adjustable spring-loaded piston utilized as the tension assembly in the second embodiment of the present invention.

As seen in FIGS. 7 and 9, the amount of tension applied by the spring-loaded piston 10 is adjustable by turning the knob 14 which can adjust the level of compression of the spring at its point of rest.

Different embodiments of the present invention may be constructed without departing from the spirit and scope thereof. It should be understood that the present invention is not limited to the specific embodiments described in this specification. To the contrary, the present invention is intended to cover various modifications and equivalent arrangements included within the spirit and scope of the present claims.

We claim:

1. A stretching device, comprising:

a seat including a sitting surface and an interior portion below said sitting surface;

an adjustable tension assembly disposed in said interior portion of said seat, parallel to said sitting surface of said seat;

a rotatable bearing assembly disposed in said interior portion of said seat at an anterior end of said tension assembly;

an axle extending upwardly perpendicular relative to said seat from said rotatable bearing assembly; and a handle extension disposed at an upper portion of said axle and extending outwardly perpendicular therefrom to accommodate the outstretched reach of the user's arms when the user is seated on said sitting surface, said handle extension being rotatable upon said axle to move in correspondence with said tension assembly.

2. A stretching device as claimed in claim 1, wherein said adjustable tension assembly includes an elastic band.

3. A stretching device as claimed in claim 1, wherein said adjustable tension assembly includes a coil spring.

4. A stretching device as claimed in claim 1, wherein said adjustable tension assembly includes a spring loaded piston.

5. A stretching device as claimed in claim 1, further comprising thigh supports attached to said seat which enable the user sitting on said seat to stabilize said seat when said handle extension is being rotated by the user.

* * * * *